United States Patent [19]

Crudup

[11] 4,010,938

[45] Mar. 8, 1977

[54] METAL TREATMENT GUN AND METHOD

[76] Inventor: Edward W. Crudup, P.O. Box 669, Bryson City, N.C. 28713

[22] Filed: Mar. 24, 1975

[21] Appl. No.: 561,226

[52] U.S. Cl. ..... 266/216

[51] Int. Cl.[2] ..... C21C 7/00

[58] Field of Search ..... 266/34 A, 34 T, 38, 266/42, 89, 216, 217, 221, 225; 302/35, 59; 75/51–58, 130–133.5, 129

[56] References Cited

UNITED STATES PATENTS

| | | | |
|---|---|---|---|
| 2,502,259 | 3/1950 | Hulme | 75/51 |
| 2,858,125 | 10/1958 | Clenny et al. | 266/34 T |
| 3,001,864 | 9/1961 | Muller et al. | 266/34 T |
| 3,137,753 | 6/1964 | Feichtinger | 266/34 T |
| 3,365,242 | 1/1968 | Marchetti | 266/225 |
| 3,615,085 | 10/1971 | Bernsmann | 266/225 |
| 3,891,196 | 6/1975 | Forster et al. | 266/34 T |
| 3,929,185 | 12/1975 | Wiener | 164/53 X |

*Primary Examiner*—Roy Lake
*Assistant Examiner*—Paul A. Bell
*Attorney, Agent, or Firm*—B. J. Powell

[57] ABSTRACT

A metal treatment gun for selectively introducing particulate metal treating material into a metallic melt below its surface which has a discharge member defining a first chamber therein closed at its upstream end and open at its downstream end so that the metallic melt will be in communication with the chamber when the downstream end is inserted below the surface of the metallic melt, an injection member defining an injection passage therethrough communicating with the first chamber intermediate its ends along with fluid drive means for forcing a fluid propellant through the passage in the injection member and into the chamber in the discharge member with feed means for introducing the particulate metal treating material into the fluid propellant flowing through the injection passage in the injection member in response to the pressure of the fluid propellant in the injection member, and pressure relief means for controlling the pressure in the chamber and the discharge member when its downstream end is in communication with the metallic melt independently of the pressure of the fluid propellant in the passage through the injection member. The disclosure also contemplates the method of operating the metal treatment gun.

5 Claims, 2 Drawing Figures

FLOW
MTM

METAL TREATMENT GUN AND METHOD

BACKGROUND OF THE INVENTION

It is frequently desirable to add various metal treating materials below the surface of a melt of molten metal to clean or flux the molten metal of the melt, change the physical characteristics of the metal, or change the manner in which the molten metal solidifies. Various devices have been proposed for adding this metal treating material to the melt of molten metal in the foundry industry. One type of device which has been proposed uses a venturi which is connected to a hopper that feeds particles of the metal treating material from the hopper into the venturi while a pressurized fluid propellant passes through the venturi to entrain the particles of the metal treating material into this stream of propellant fluid and injects the treating material in the melt. When the stream of fluid propellant with the particles of metal treating material entrained therein is submerged under the surface of a molten metal, the particles of the metal treating material as well as the fluid propellant will be injected into the melt of molten metal. One of the primary problems with this type of devive is all of the fluid propellant must be ejected from the end of the discharge tube into the melt of molten metal. This frequently creates undue agitation in the molten metal that results in a detriment to the molten metal such as oxidation. This is especially true in melts of non-ferrous metals such as aluminum.

SUMMARY OF THE INVENTION

These and other problems and disadvantages associated with the prior art are overcome by the invention disclosed herein in that the rate of flow of the fluid propellant from the discharge end of the discharge tube of a venturi type metal treating material injection device is controlled independently of the amount of fluid propellant passing through the venturi to entrain the particles of metal treating material therein. This results in keeping the agitation in the melt to a minimum while insuring the introduction of the proper amount of metal treating material therein to prevent the detrimental affects of over agitation to the melt of molten metal.

The apparatus of the invention includes generally a metal treatment gun for selectively introducing particulate metal treating material into a melt of molten metal which has a discharge tube with a discharge chamber therein closed at its upstream end and open at its downstream end so that its downstream end may be submerged below the surface of the molten metal. The gun also has an injection tube defining an injection passage therethrough which opens into the discharge chamber defined in the discharge tube upstream of the surface of the molten metal, a pressurized fluid supply connected to the injection tube for forcing a fluid propellant under pressure through the injection passage in the injection tube, a propellant pressure regulator to control the flow of the fluid propellant from the pressurized fluid supply through the injection tube, feed means for introducing the particulate metal treating material into the central passage through the injection tube in response to the flow of the fluid through the injection tube, and a pressure relief regulator connected to the discharge chamber in the discharge tube for independently maintaining a second regulated pressure in the discharge tube when the discharge end thereof is submerged below the surface of the melt of molten metal. The propellant pressure regulator controls the flow of the fluid propellant from the pressurized fluid supply through the injection tube to control the amount of particulate metal treating material injected into the chamber in the discharge tube while the pressure relief regulator controls the resulting pressure in the discharge chamber above the surface of the molten metal of the melt so as to control the amount of agitation in the melt due to the fluid propellant ejected from the end of the discharge tube.

The method of invention includes placing the discharge tube defining a discharge chamber therein which is closed at its upstream end and open at its downstream end into a melt of molten metal so that the discharge end of the discharge tube lies below the surface of the molten metal, injecting a fluid propellant medium with particles of metal treating material entrained therein into the chamber at a first pressure, and independently regulating the pressure in the discharge chamber to control the rate of flow of the fluid propellant from the discharge end of the discharge tube through the melt of molten metal.

These and other features and advantages of the invention will become more clearly understood upon consideration of the following specification and accompanying drawings wherein like characters of reference designate corresponding parts throughout the several views and in which:

Figures 1, 2:
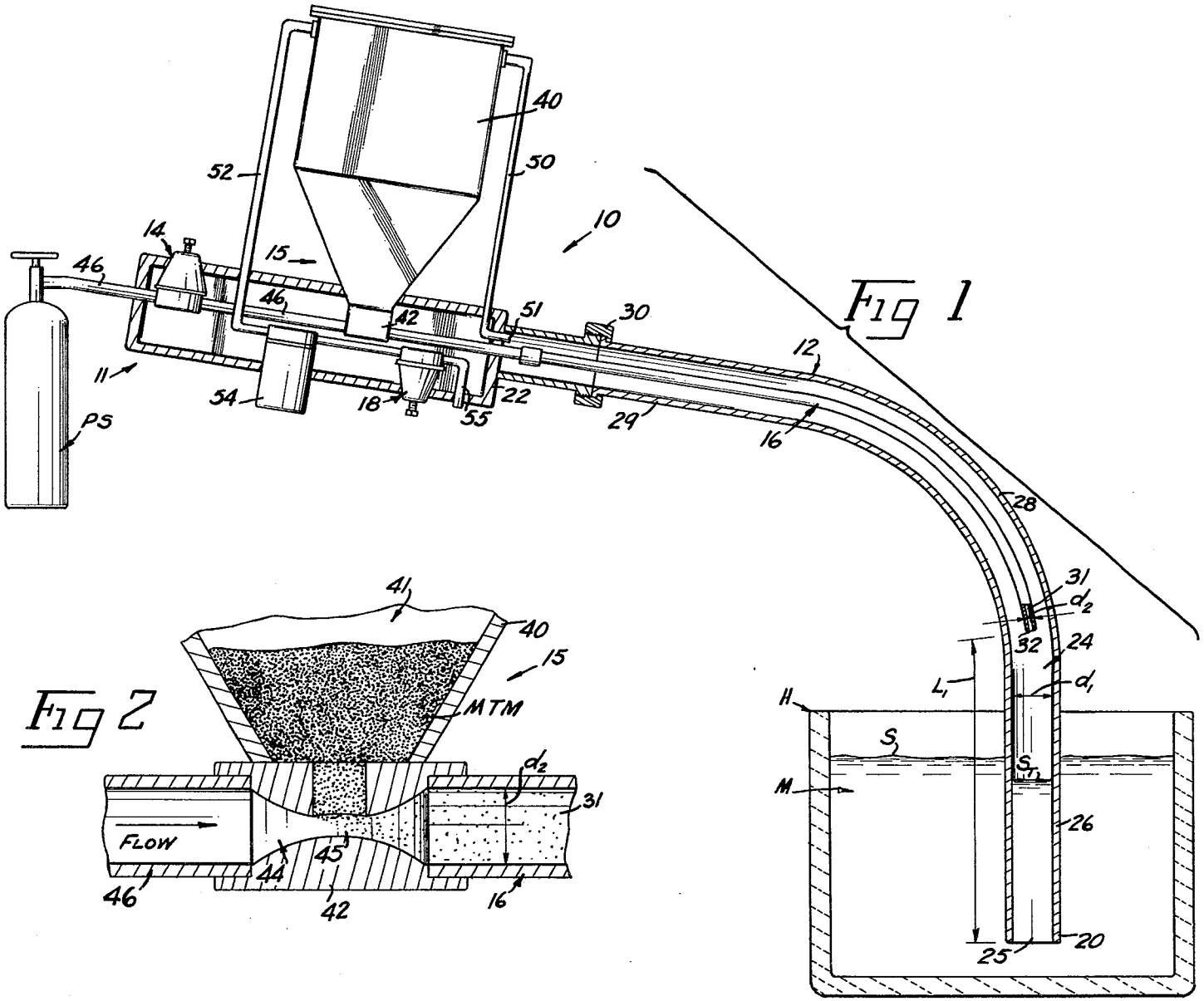
FIG. 1 is a side elevational view of one embodiment of the invention shown partly in cross-section; and, FIG. 2 is an enlarged longitudinal cross-sectional view of the venturi using the invention.

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Referring to FIGS. 1 and 2, it will be seen that the metal treatment gun 10 is used to introduce particulate metal treating material into a melt M of molten material which is usually carried in a crucible or other holding device H. Various metal treating materials may be added to the melt M in particulate form such as flux material, materials for modifying or refining the melt or other agents. Fluxing materials for non-ferrous metals such as aluminum are usually chloride or floride base compounds or a combination thereof. The treatment gun 10 is usually powered by a pressurized source PS of fluid propellant such as a gas, introduces the particulate metal treating material MTM into a stream of fluid propellant moving through the gun, and discharges part of the fluid propellant and the particulate material below the surface S of the melt M.

As illustrated in FIG. 1, the treatment gun 10 includes generally a housing 11 which mounts a discharge tube 12, a propellant pressure regulator 14, feed means 15, an injection tube 16 and a pressure relief regulator 18 thereon. The discharge tube 12 is inserted below the surface of the melt M and the particulate metal treating material is fed into the injection tube 16 by the feed means in response to the flow of the fluid propellant through the injection tube as regulated by the pressure regulator 14. The fluid propellant with the particulate metal treating material entrained therein is discharged from the injection tube 16 into the discharge tube 12 above the surface of the melt within the tube 12. The particulate material then falls onto the surface of the melt within the discharge tube. The back pressure in the discharge tube is regulated by the pressure relief regulator 18 so that the pressure in the discharge tube is regulated independently of the pressure of the fluid propellant in the injection tube to regulate the amount of fluid propellant being discharged out of the open downstream end of the discharge tube into the melt of molten metal below its surface. That portion of the fluid propellant being discharged into the melt carries the particulate metal treating material in the discharge tube therewith into the melt for reaction.

As seen in FIG. 1, the various components of the treatment gun 10 are carried by the housing 11 so that the gun 10 can be moved about the melt M of molten metal with the downstream discharge end 20 of the discharge tube 12 submerged below the surface of the melt M. The housing 11 has a front wall 22 to which the upstream end 21 of the discharge tube 12 is attached. The discharge tube 12 defines a central passage or chamber 24 therethrough of diameter $d_1$ with a discharge opening 25 at the downstream end 20 of the discharge tube 12. Thus, it will be seen that passage 24 is open at its downstream end and closed at its upstream end by the front wall 22 on the housing 11. It will further be seen that the discharge tube 12 has a generally straight lower section 26 adjacent the downstream end 20 which is held generally vertical while the metal treating material is being injected below the surface of the melt M of molten metal, an intermediate upward curved section 28 with an upper generally straight section 29 defining a convenient angle A between the lower section 26 and the upper section 29 so that the housing 11 is located at a convenient angle for supporting the gun 10. The discharge tube 12 may be made with a replacable downstream section through coupling 30.

The injection tube 16 extends through the front wall 22 of housing 11 into the passage 24 in the discharge tube 12 and extends coaxially therealong. The injection tube 16 defines a passage 31 therethrough of diameter $d_2$ smaller than diameter $d_1$. The upstream end of tube 16 is connected to the feed means 15 in housing 11 and the downstream end 31 of tube 16 has an open mouth 32 to the passage 31. The downstream end of tube 16 is located a prescribed distance $L_1$ upstream of the downstream end 20 of the discharge tube 12 so that the mouth 32 of the injection tube 16 is located above the surface $S_T$ of the melt M within the tube 12. The injection tube 16 is curved similarly to the discharge tube 12 so that the passage 31 extends generally downwardly adjacent the mouth 32 as will become more apparent.

The feed means 15 includes a hopper 40 which has a feed chamber 41 therein that carries a supply of the particulate metal treating material MTM as seen in FIG. 2. A venturi feeder 42 is connected to the bottom of the hopper 40 and defines a venturi passage 44 therethrough. The throat 45 of the venturi passage 44 communicates with the feed chamber in hopper 40 and the outlet end of the venturi passage 44 communicates with the passage 31 at the upstream end of the injection tube 16. The inlet end of the venturi passage 44 is connected to the pressurized source PS of fluid propellant through the propellant pressure regulator 14 by pipe 46. As the fluid propellant is forced through the venturi passage 44 and along the injection tube 16, the pressure differential at the throat 45 causes the particulate metal treating material to be sucked into the stream of fluid propellant and be entrained therein. Because the pressure differential at the throat of the venturi passage 44 is determined by the volume of flow of the fluid propellant through the passage 44, adjusting the pressure in the injection tube 16 by adjusting regulator 14 serves to vary the amount of particulate metal treating being entrained in the stream of fluid propellant. This results in selective adjustment of the amount of metal treating material being injected into the discharge tube 12 and into the melt M. While various fluid propellants may be used, that illustrated is a gas such as nitrogen which is especially useful in the treatment of aluminum.

A pressure relief pipe 50 extends through the wall 22 of housing 11 with its passage at the pickup end 51 communicating with the upstream end of the passage 24 in the discharge tube 12. The opposite end of pipe 50 communicates the chamber 41 in hopper 40 above the particulate metal treating material to pressurize the chamber 41 and facilitate the feeding of the treating material into the fluid propellant stream passing through the venturi passage 44. Another pressure relief pipe 52 communicates with the chamber 41 above the treating material and is connected to the pressure relief regulator 18 so that the pressure in the passage 24 in the discharge tube 12 and in the chamber 41 in hopper 40 can be regulated independently of the pressure in the injection tube 16. A filter 54 may be connected in pipe 52 to separate any particulate metal treating material before it escapes through the relief regulator 18. Alternatively, the relief pipe 50 may be connected directly to the relief regulator 18.

OPERATION

In use, the hopper 40 is filled to a prescribed level with the metal material MTM which is desired to be added to the melt M of molten metal. The pipe 46 upstream of the propellant pressure regulator 14 is connected to the pressurized supply PS of fluid propellant, here shown as a cylinder of compressed gas such as nitrogen. The downstream end 20 of the discharge tube 12 is submerged below the surface of the melt M and is usually extended down to the vicinity of the bottom of the crucible H. This causes the melt M to rise inside of the tube 12 in the passage 24.

The propellant pressure regulator 14 is adjusted so that its regulated pressure outlet controls the flow of the fluid propellant through the venturi passage in the feeder 42 to control the amount of metal treating material MTM being entrained in the fluid propellant as it passes therethrough. The fluid propellant with the particulate metal treating material MTM entrained therein is discharged out of the opening 32 at the end of the injection tube 16 in a generally downstream direction in the passage 24 in the discharge tube 12 above the surface $S_T$ of the melt M. The diameter $d_1$ of the passage 24 in the discharge tube 12 is considerably larger than the diameter $d_2$ of the passage 30 in the injection tube 16. Thus, the fluid propellant expands within the passage 24 and slows down, however, the metal treating material, being heavier, continues to travel downwardly in the passage 24 toward the discharge end 20 of the tube 12 because of its kinetic energy and under the force of gravity. While the fluid propellant expands in the passage 24, it serves to pressurize same so that the surface $S_T$ of the melt within the passage 24 of the tube 12 is generally lower than the surface $S_L$ as is readily appreciated. While a number of different diameters may be used depending on the particular requirement of the gun 10, one size that has been used is where the diameter $d_1$ is approximately four times the diameter $d_2$.

Usually, the required pressure in the injection tube 16 as set by the propellant regulator 14 in order to supply the metal treating material MTM to the passage 24 in discharge tube 12 at the desired rate is considerably higher than that needed to force the metal treating material from the discharge end 20 of the tube 12 below the surface $S_T$ of the melt M. The relief pressure regulator 18 is then adjusted so that its regulated pressure inlet reduces the pressure within the passage 24 to the minimum level which is required to force the metal treating material into the melt M below the surface. This smaller pressure in the passage 24 causes some of the fluid propellant to be forced downwardly through the melt M and out of the mouth 25 in the discharge end 20 of the tube 12. As this fluid propellant is forced out of the tube 12 through the mouth 25, it forces the metal treating material therewith out into the melt M. Thus, the agitation to the melt M caused by the fluid propellant being discharged from the discharge end 20 of the tube 12 is reduced to a minimum.

It will also be noted that the pickup end 51 of the pressure relief pipe 50 is positioned in the upstream-most end of the passage 24 at a level which is higher than the opening 32 in the injection tube 16 to minimize the amount of metal treating material which will be allowed to escape out of the pressure release pipe 50. The pressure relief regulator 18 also causes the feed chamber 41 and the hopper 40 to be pressurized at substantially the same pressure as that of the passage 24 in the discharge tube 12 to better regulate the amount of metal treating material entrained in the stream of fluid propellant fluid flowing through the venturi passage 44. Appropriate baffles may be provided in the feed chamber 41 in hopper 40 to help separate any metal treating material picked up by the pressure release pipe 50 and further, the filter 54 removes any remaining metal treatment material from the fluid propellant passing out of the escape pipe 55 from the pressure relief regulator 18. Any number of different types of pressure regulator valves 14 may be used as well as any number of different types of pressure relief regulator valves 18 may be used.

While different pressures will be used depending on the application, it has been found that a pressure setting of approximately 25 psi by the propellant pressure regulator 14 when using a gas propellant such as dry nitrogen will cause a sufficient amount of metal treating material MTM to be entrained in the gas stream and discharged into the passage 24 in the discharge tube 12. It has also been found that a pressure setting of 20 to 23 psi on the pressure relief regulator 18 insures that a sufficient amount of the gas propellant will be forced out of the mouth 25 in the discharge tube 12 to mix the metal treating material MTM with the melt M, especially in relatively small melt molten metals such as aluminum while keeping the agitation to a minimum.

It is to be understood that full use of modifications, substitutions and equivalents may be made without departing from the scope of the inventive concept as disclosed herein.

I claim:

1. A metal treatment gun for selectively introducing particulate metal treating material into a metallic melt below its surface comprising:

a discharge tube defining a discharge chamber therethrough with a first cross-sectional area, the upstream end of said discharge tube being closed and the downstream end of said discharge tube being open so that the metallic melt will be in communication with said discharge member when the downstream end is inserted below the surface of the metallic melt;

an injection tube defining an injection passage therethrough having an outlet end communicating with said first chamber intermediate its ends above the metallic melt;

fluid drive means operatively connected to said injection passage through said injection tube for selectively forcing a fluid propellant through said injection passage under a first pressure so that said fluid propellant is discharged into said discharge chamber toward the downstream end thereof;

feed means for introducing the particulate metal treating material into said fluid propellant flowing through said injection passage in said injection tube for entrainment of the particulate metal treating material in the fluid propellant so that the entrained particulate metal treating material will be discharged into said discharge chamber with said fluid propellant; and, pressure relief means operatively communicating with said discharge chamber upstream of the outlet end of said injection tube for selectively controlling the pressure in said discharge chamber when its downstream end is in communication with the metallic melt independently of the pressure within said injection passage of said injection tube so that a second pressure is maintained in said first chamber lower than said first pressure in said injection passage by allowing a prescribed portion of said fluid propellant to escape from said first chamber without passing into said metallic melt.

2. The metal treatment gun of claim 1 wherein said fluid drive means includes a pressurized gas supply and pressure regulating means operatively connecting said pressurized gas supply with said injection passage in said injection member for selectively regulating the pressure of the gaseous propellant passing through said injection passage.

3. The metal treatment gun of claim 2 wherein said pressure regulating means is adjustable to change the pressure in said injection passage.

4. The metal treatment gun of claim 1 wherein said feed means includes a venuri operatively associated with said injection tube for generating a pressure drop at the throat thereof, and hopper means for holding the particulate metal treating material in communication with the throat of said venturi for causing said particulate metal treating material to be drawn into said fluid propellant passing through said venturi.

5. The metal treatment gun of claim 1 wherein said pressure relief means includes an adjustable pressure relief regulator having its pressure regulated inlet in communication with said discharge chamber upstream of the outlet end of said injection tube.

* * * * *